US005257477A

United States Patent [19]

Kvasnes

[11] Patent Number: 5,257,477

[45] Date of Patent: Nov. 2, 1993

[54] ROLLER MECHANISM FOR SLIDING PANEL

[75] Inventor: Oddmund J. Kvasnes, Alesund, Norway

[73] Assignee: Kvasnes of Norway, Ltd., Blue Earth, Minn.

[21] Appl. No.: 764,779

[22] Filed: Sep. 24, 1991

[51] Int. Cl.[5] ..... E05D 15/56

[52] U.S. Cl. ..... 49/235; 16/99; 49/425

[58] Field of Search ..... 49/235, 234, 232, 233, 49/425, 226; 16/99

[56] References Cited

U.S. PATENT DOCUMENTS

| | | | |
|---|---|---|---|
| 1,898,583 | 2/1933 | Madland | 16/99 |
| 2,263,468 | 11/1941 | Oleksiw | 16/99 |
| 2,286,974 | 6/1942 | Oleksiw | 49/235 X |
| 2,386,385 | 10/1945 | Ditchfield | 16/99 |
| 4,434,678 | 3/1984 | Maus . | |
| 4,453,345 | 6/1984 | Maus . | |
| 4,551,945 | 11/1985 | von Resch . | |
| 4,562,667 | 1/1986 | von Resch . | |
| 4,590,707 | 5/1986 | von Resch . | |
| 4,633,616 | 1/1987 | Giguere | 49/425 |

FOREIGN PATENT DOCUMENTS

| | | | |
|---|---|---|---|
| 253379 | 4/1967 | Austria | 49/235 |
| 603189 | 9/1934 | Fed. Rep. of Germany | 16/99 |
| 326892 | 1/1958 | Switzerland | 49/235 |

*Primary Examiner*—Philip C. Kannan
*Attorney, Agent, or Firm*—Dorsey & Whitney

[57] ABSTRACT

A sliding panel assembly is provided. A roller mechanism allows the sliding panel to slide between an open position and a closed position. The roller mechanism has a carriage assembly connected to an elongated support member. The sliding panel is fixed to the elongated support member. The carriage assembly is connected to the elongated support member by a plurality of link mechanisms. The carriage assembly carries a plurality of wheels which ride in a track. The link mechanisms allow the sliding panel to be locked in a weatherproof seal against a framed opening in which the sliding panel is placed. The link mechanisms also allow the sliding panel to be removed from the weatherproof seal to facilitate movement of the sliding panel along the track.

8 Claims, 5 Drawing Sheets

ROLLER MECHANISM FOR SLIDING PANEL

BACKGROUND OF THE INVENTION

This invention relates generally to a sliding panel assembly. In particular, this invention provides a mechanism for allowing a sliding panel, such as is used in a sliding glass door assembly, to slide between an open position and a closed and locked position. When the sliding panel is closed, the mechanism of this invention ensures that a weather tight seal is created between the sliding panel and the frame surrounding the opening for the sliding panel.

Today many homes are designed with sliding glass doors that provides access to patios, porches, decks and the like. These sliding glass doors are desirable because the large glass panels offer a panoramic view of the area outside of the home while simultaneously providing access thereto. Unfortunately, sliding glass doors can be a source of thermal inefficiency.

For homes located in regions that experience extreme temperature fluctuations, such as the upper midwestern region of the United States, this thermal inefficiency is a significant drawback. In these locations, it is important that the sliding panel can be tightly sealed against the door frame. In the winter, this prevents cold air from entering the home or warm air from leaving the home through passages between the door frame and the sliding panel. Similarly, in the summer, this seal prevents either the hot summer air from entering the home or prevents cool air conditioned air from leaving the home. In addition, it is important that the sliding panel can be easily moved to provide access to the area outside of the home. This is particularly important when the temperature moderates, such as in the spring, and homeowners engage in outdoor activities.

It therefore would be desirable to provide a sliding panel such as is used in a sliding glass door assembly that can create a weatherproof seal with the frame that holds the sliding panel.

It would also be desirable to provide a sliding panel such as is used in a sliding glass door assembly that can be easily slid out of the way when access to the area outside of the home is desired.

SUMMARY OF THE INVENTION

It therefore is an object of this invention to provide a sliding panel such as is used in a sliding glass door assembly that can create a weatherproof seal with the frame that holds the sliding panel.

It is another object of this invention to provide a sliding panel such as is used in a sliding glass door assembly that can be easily slid out of the way when access to the area outside of the home is desired.

Although this invention will be described in terms of a sliding panel that is used as part of a sliding glass door assembly, it is to be understood that this invention is applicable to any structural opening such as a door, a window or the like where a sliding panel can be used.

In accordance with this invention, there is provided a sliding glass door assembly and a door frame member which is attached to each edge of the opening into which the sliding glass door assembly is placed. The top and bottom portion of the door frame are fitted with tracks. These tracks allow the sliding panel to be easily moved from side to side in the door frame. The sliding glass door assembly comprises a fixed panel portion and a sliding panel portion. The sliding panel comprises a frame that supports the glass panel, one or more elongated support members fixed to the sliding panel frame, one or more carriage members, a plurality of linkage mechanisms connecting the carriage members to the elongated support members and a foot pedal or handle mechanism operatively connected to one of the carriage members. Alternatively, the plurality of linkage mechanisms may be connected directly to the sliding panel frame obviating the need for the elongated support member. The number of carriage members used depends on the size of the sliding panel.

Each carriage member has a pair of wheels rotatably connected thereto. These wheels travel along the track fixed in the bottom of the door frame. When more than one carriage member is used, the carriage members are connected end to end by a rigid connecting member. Each carriage member has one end of a suspension link pivotally connected to it at about the midsection thereof. The other end of each of these suspension links is pivotally connected to an elongated support member. This arrangement of the carriage members and the elongated support members allows the sliding panel to be raised and lowered into the travel position and the locked position respectively.

When the sliding panel is displaced to its lowermost position, it is locked against weatherstripping elements disposed along the door frame. This prevents the sliding panel from moving and it also prevents air from leaking between the door frame and the sliding panel. When the sliding panel is displaced from its lowermost position, it is unlocked from the weatherstripping elements and the door frame and can be slid horizontally along the tracks to an open position to allow access through the door frame.

To facilitate the upward and downward movement of the sliding panel, one carriage member and one elongated support member are connected by a second linkage mechanism. Only one of these second linkage mechanisms is used for the sliding panel. This second linkage mechanism has one end of a connection link pivotally connected to one end of the carriage member, one end of a bell crank pivotally connected to the other end of the connection link and the other end of the bell crank link pivotally connected to one end of the elongated support member. A tab is preferably used to lengthen the elongated support member.

A foot pedal or handle is operatively connected to the second linkage mechanism. When the foot pedal is rotated, the square shank about which the bell crank is attached causes the bell crank to rotate which in turn causes the sliding panel to move up or down. Depending on the direction of the movement of the foot pedal, the sliding panel either is lowered to seal the sliding panel in place or raised to facilitate the horizontal movement of the sliding panel along the tracks. The foot pedal also carries a stub shaft at one end. This stub shaft can engage a latch on the door frame to lock the sliding panel in its fully closed position.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
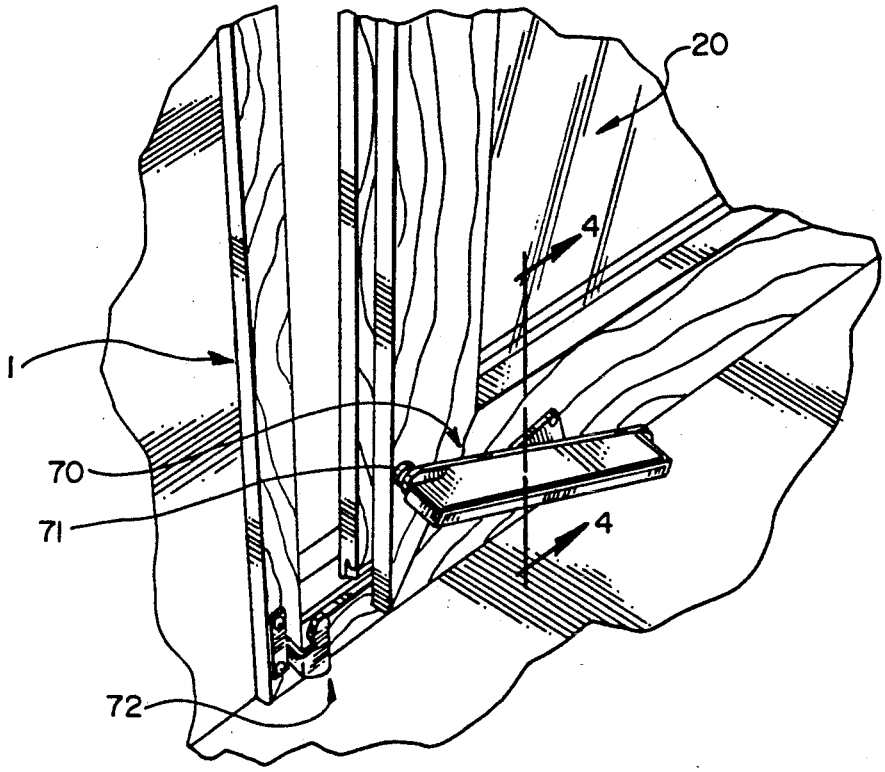
FIG. 1 is a fragmentary perspective view of the lower front portion of the sliding panel of this invention showing the foot pedal.
Figure 2:
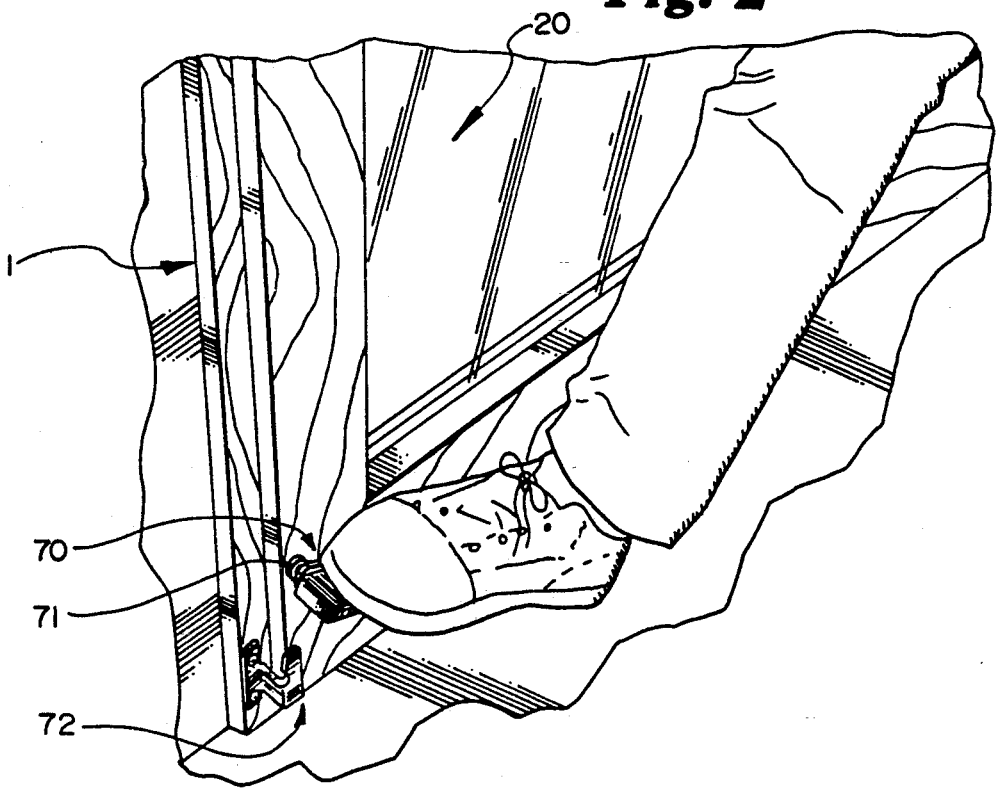
FIG. 2 is a fragmentary perspective view of the lower front portion of the sliding panel of this invention showing how the foot pedal is used to slide the sliding panel from the open position to the closed position.
Figure 3:
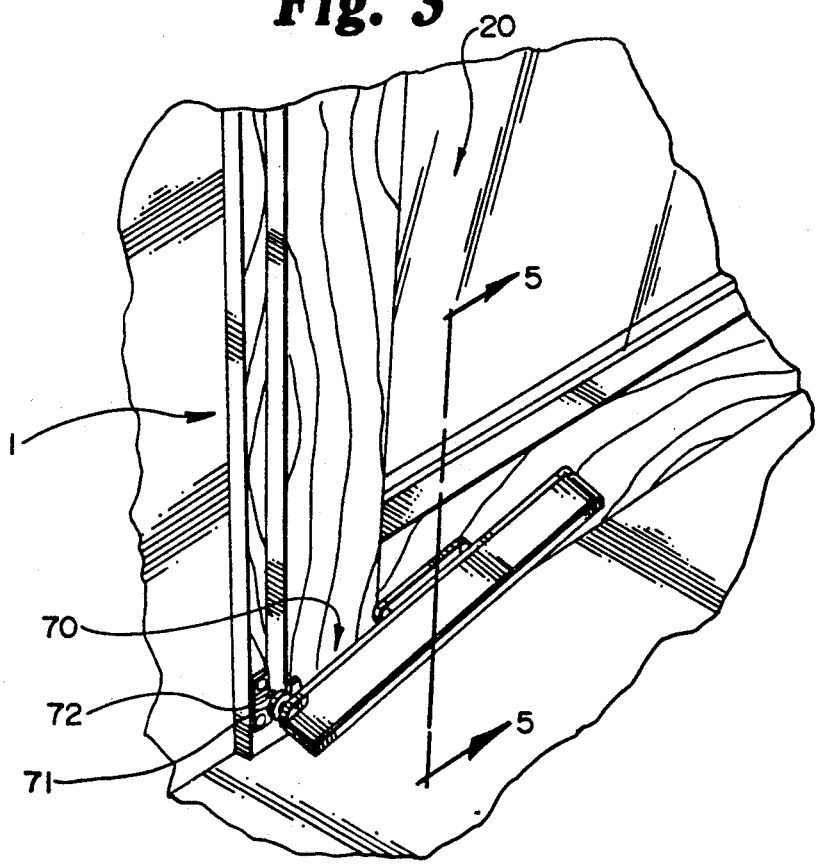
FIG. 3 is a fragmentary perspective view of the lower front portion of the sliding panel of this invention showing the foot pedal stub shaft engaged with the latch to lock the sliding panel in the closed position.
Figure 4:
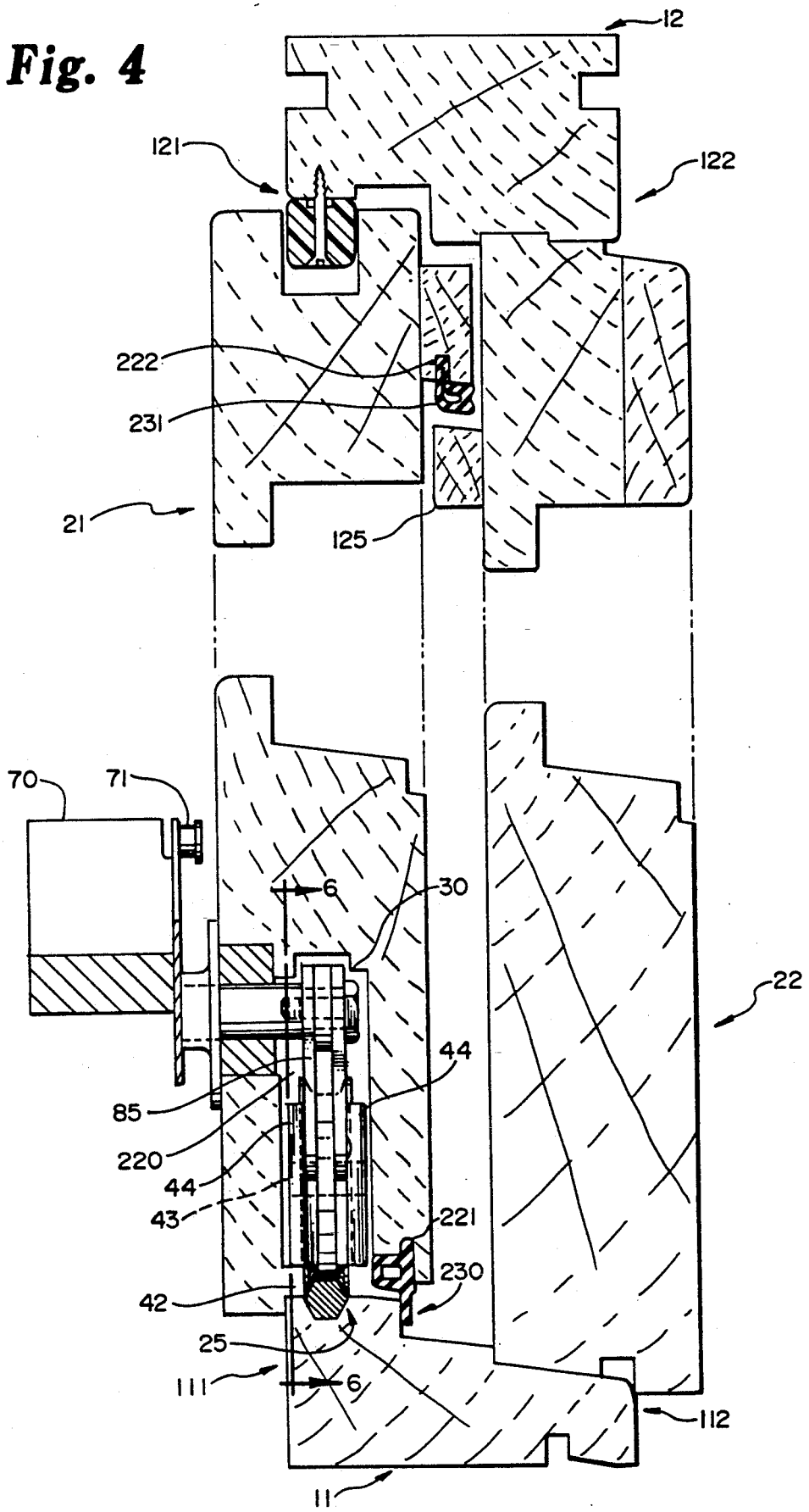
FIG. 4 is a cross sectional view taken along line 4—4 of FIG. 1.
Figure 5:
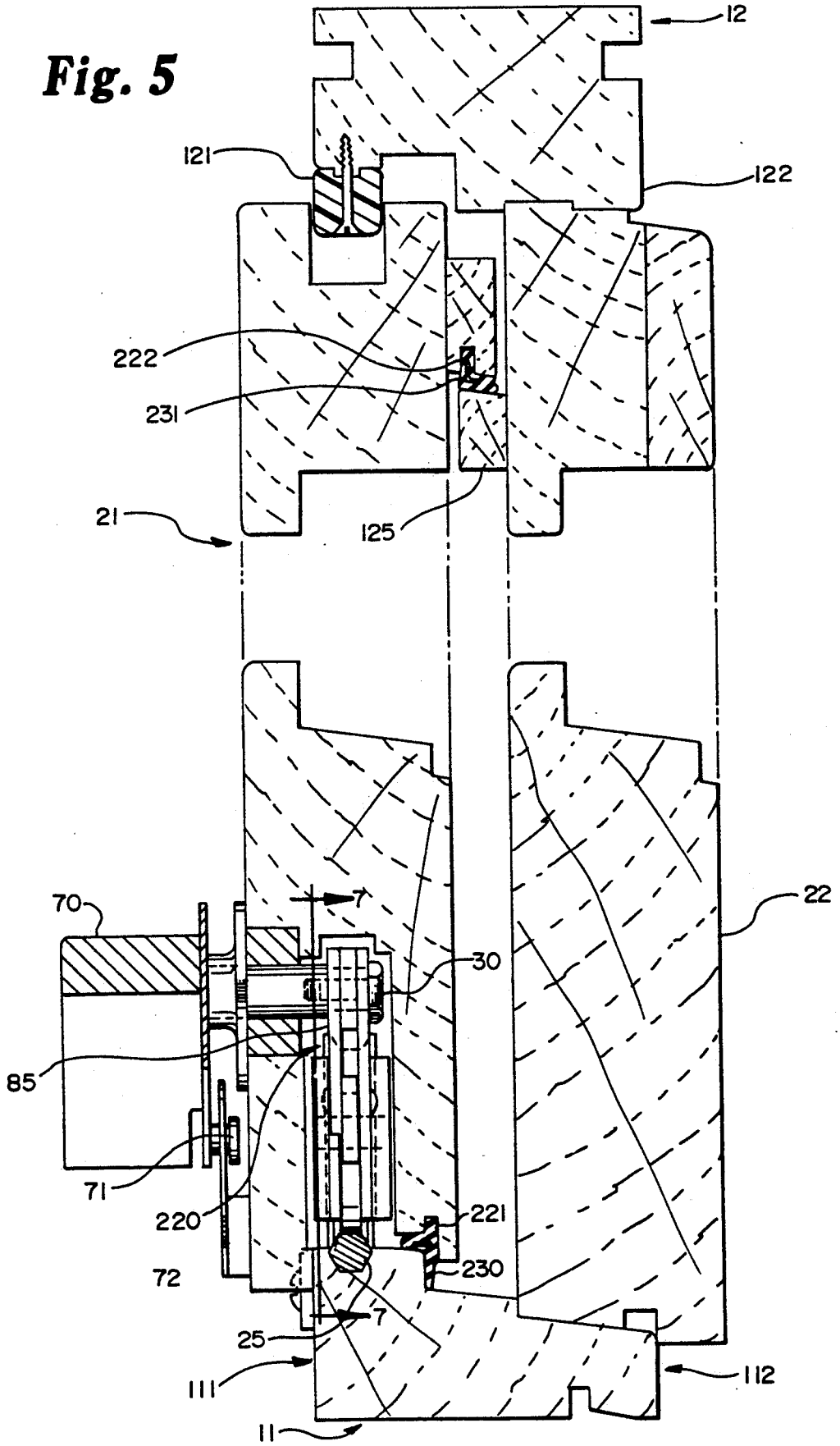
FIG. 5 is a cross sectional view taken along line 5—5 of FIG. 3.

A frame 1 is disposed along each edge of the opening into which the sliding glass door assembly 20 is placed. Preferably frame 1 is made from wood. However other suitable framing members could also be used. Frame 1 has a bottom frame member 11, an upper frame member 12 and two side frame members. Only one of these two side frame members is shown in FIGS. 1, 2 and 3.

Bottom frame member 11, which is positioned along the bottom of the opening, preferably is tiered. Bottom frame member 11 has a front portion 111 and a rear portion 112. Front portion 111, i.e. the portion adjacent to the interior of the home, of bottom frame member 11 has the highest level. A rod 25 is disposed on top of front portion 111 and extends along the entire length of bottom frame member 11. This rod 25 serves as a track for the sliding panel 21 of sliding glass door assembly 20. Preferably rod 25 has a hexagonal cross section with the top half of rod 25 exposed above the top surface of bottom frame member 11. However a different cross sectional shape could also be used for rod 25. Rear portion 112 holds the fixed panel 22. Fixed panel 22 can be fixed to frame 1 by any conventional means.

Upper frame member 12 also has a front portion 121 and a rear portion 122. Front portion 121 serves as the upper track for sliding panel 21. Upper frame member 12 also has a ledge portion 125 located along a portion of upper frame member 12 that is covered by sliding panel 21 when it is closed and that extends inwardly toward the interior of the home from rear portion 122.

Sliding panel 21 comprises a panel frame and and at least one glass panel fixed in the panel frame. Any standard thermally efficient glass panel can be used. The glass is fixed to the panel frame by any conventional means.

Two slots 220 and 221 are formed in the bottom of sliding panel 21. Front slot 220 houses the roller mechanism 30. Rear slot 221 holds a first standard weatherstripping element 230 in place between bottom frame member 11 and the bottom of sliding panel 21. The front of the bottom of sliding panel 21 extends below the top of the front of bottom frame member 11 when sliding panel 21 is placed in frame 1. The distance of this extension should be sufficient to allow the front of the bottom of sliding panel 21 to cover the top of the front of bottom frame member 11 when sliding panel 21 is displaced between its upper and lower positions during the operation of sliding panel 21. This ensures an aesthetically pleasing appearance for sliding panel 21 and bottom frame member 11 and also contributes to the weatherproof characteristic of sliding glass door assembly 20.

First weatherstripping element 230 is disposed between the bottom of sliding panel 21 and bottom frame member 11. An intermediate portion of the bottom of sliding panel 21 compresses the body of first weatherstripping element 230 against bottom frame member 11 when sliding panel 21 is in its lowered and locked position in frame 1. Rear slot 221 in the bottom of sliding panel 21 in conjunction with the rear of the bottom of sliding panel 21 keeps first weatherstripping element 230 in place when sliding panel 21 is raised to a higher position in frame 1. The combination of first weatherstripping element 230 and the configuration of bottom of sliding panel 21 prevents air from passing between the bottom of sliding panel 21 and bottom frame member 11 during the operation of sliding glass door assembly 20.

The top of sliding panel 21 fits in front portion 121 of upper frame member 12 in a tongue and groove fashion. The top of sliding panel 21 has a rear portion defining a slot 222. This slot 222 holds a portion of a second standard weatherstripping element 231. The end of the rear portion of the top of sliding panel 21 also serves to sandwich second weatherstripping element 231 between the ledge 125 of rear portion 122 of upper frame member 12 and the rear portion of the top of sliding panel 21.

When sliding panel 21 is lowered to its lowermost position, both first and second weatherstripping elements 230 and 231 are compressed creating a weatherproof seal. In addition, sliding panel 21 is locked in place and cannot be slid along rod 25. When sliding panel 21 is raised, the compression on the two weatherstripping elements is released. At that point, the weatherproof seal is broken and sliding panel 21 can be slid along rod 25 to an open position to allow access through the door frame opening.

Roller mechanism 30 facilitates both the up and down movement of sliding panel 21 and the horizontal movement of sliding panel 21 along rod 25. Roller mechanism 30 comprises at least one carriage member 40, an elongated support member 50, a linkage mechanism 60 connecting each carriage member 40 to each elongated support member 50 and a foot pedal 70 or handle (not shown) for displacing sliding panel 21 between different vertical positions. The number of carriage members 40 used depends on the size of sliding panel 21. For a standard size sliding panel, preferably two carriage members 40 connected end to end by a rigid connecting member 41 are used. For sliding panels of different sizes, a different number of carriage members 40 can be used. However, the number of carriage members 40 used should be enough to create a stable platform for sliding panel 21 when it is moved in the horizontal direction between open and closed positions. Preferably roller mechanism 30 is made from stainless steel.

Each carriage member 40 carries wheels 42 that allow sliding panel 21 to be rolled along rod 25. Preferably each carriage member 40 contains two wheels 42. Of course, any number of wheels 42 could be used as long as carriage member 40 continues to provide a stable platform for sliding panel 21.

Each wheel 42 rotates about an axle 43 fixed between two side pieces 44 that form the frame for carriage member 40. Each wheel 42 preferably is formed with an annular groove about its circumference. This annular groove is designed to fit snugly over rod 25 that forms the bottom track. In addition, this configuration ensures that wheels 42 roll smoothly and quietly along rod 25.

Each carriage member 40 is also preferably connected to elongated support member 50 which is fixed to the bottom of sliding panel 21. However, carriage members 40 could also be connected directly to sliding panel 21. Elongated support member 50 is fixed by screws or other fixing means to the top of front slot 220 at the bottom of sliding panel 21.

Each carriage member 40 is connected to each elongated support member 50 by a suspension link 51. One end of suspension link 51 is preferably connected to a pin 52 located between side pieces 44 at about their midpoint. The other end of suspension link 51 is connected to a pin 55 located in a pin holding assembly on elongated support member 50. The size of suspension link 51 and the tongue and groove configuration of upper frame member 12 and the top of sliding panel 21 should have dimensions that allow sliding panel 21 to move horizontally without jamming against upper frame member 12 when suspension link 51 in substantially vertically aligned.

The movement of suspension link 51 and thus the movement of elongated support member 50 and sliding panel 21 are limited by a stop pin 65 on carriage member 40 and a rests 66 located on elongated support member 50.

Figure 6:
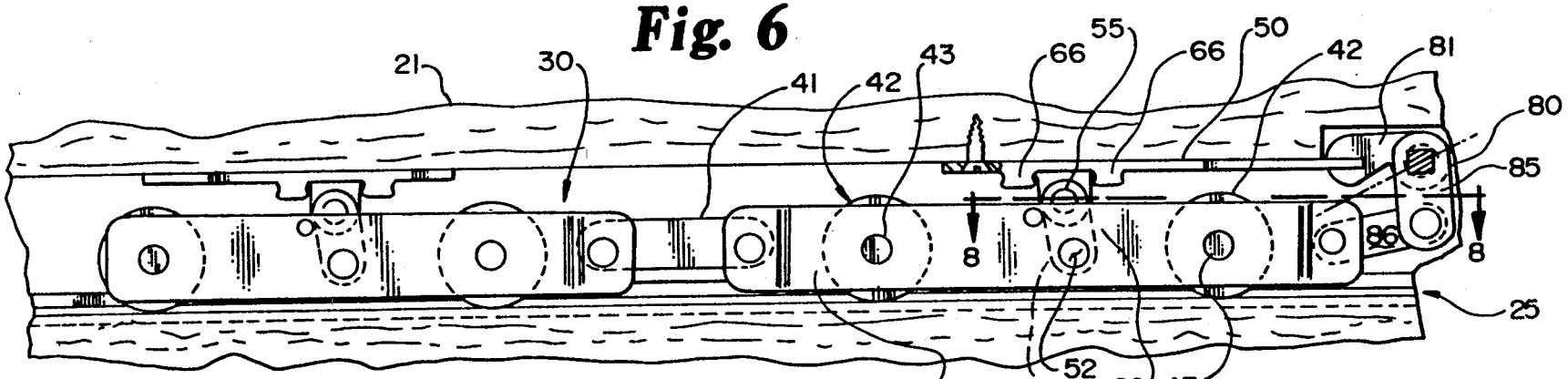
FIG. 6 is a cross sectional view taken along line 6—6 of FIG. 4.
Figure 7:
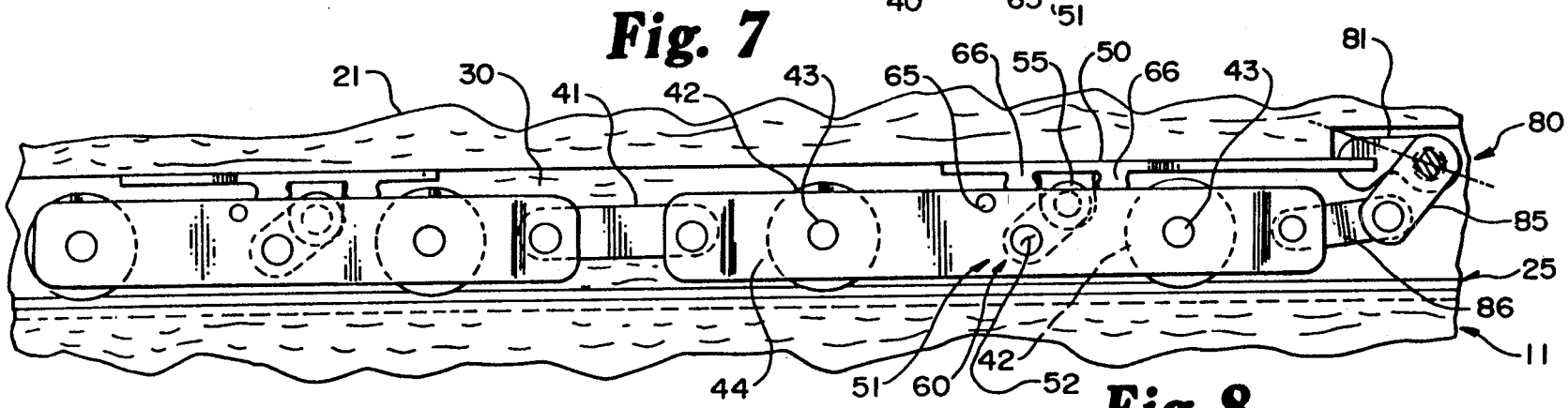
FIG. 7 is a cross sectional view taken along line 7—7 of FIG. 5.
Figure 8:
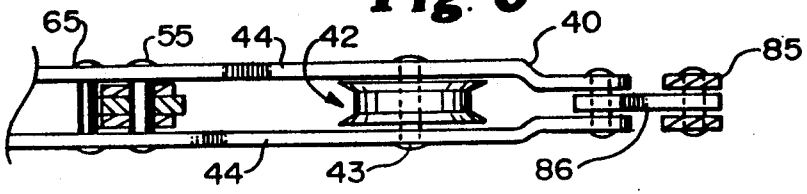
FIG. 8 is a top plan fragmentary view taken along line 8—8 of FIG. 6.

Stop pin 65, such as a shaft, is located adjacent to suspension link 51 on each carriage member 40. Preferably stop pin 65 is located adjacent to the left of suspension link 51 as seen in FIGS. 6 and 7 to prevent suspension link 51 from rotating substantially past the vertical when sliding panel 21 is being raised.

Rests 66, such as one or more blocks extending downwardly from elongated support member 50, limits the rotation of suspension link 51 in the other direction. The height of rests 66 limits the downward movement of sliding panel 21. The dimensions and exact locations of rests 66 should be of a value that allows sliding panel 21 to compress both weatherstripping elements 230 and 231 when sliding panel 21 is locked in place. Similarly, stop pin 65 should also allow sliding panel 21 to move to an unlocked position so it can move along rod 25.

One end of elongated support member 50 is also connected to one end of carriage member 40 by a second linkage mechanism 80. This second linkage mechanism 80 allows a person operating a foot pedal 70 or a handle (not shown) connected to foot pedal 70 to raise or lower sliding panel 21. Only one such second linkage mechanism 80 is needed for each sliding panel 21. Second linkage mechanism 80 is connected to a tab 81 which is connected to one end of elongated support member 50. Alternatively, second linkage mechanism 80 could be connected directly to sliding panel 21 if suspension links 51 are connected directly to sliding panel 21.

Second linkage mechanism 80 comprises a bell crank 85 pivotally connected at one end to tab 81 and a connection link 86 having one end pivotally connected to bell crank 85 and the other end pivotally connected to the end of carriage member 40. Foot pedal 70, which may have an upwardly extending handle (not shown), is connected to a shaft which in turn is rigidly connected to bell crank 85.

By depressing one end of foot pedal 70, sliding panel 21 is caused to move downwardly into tight engagement with first weatherstripping element 230 on bottom frame member 11 and second weatherstripping element 231 on ledge 125. Conversely when the other end of foot pedal 70 is depressed, sliding panel 21 is caused to move upwardly out of tight engagement with bottom frame member 11 and ledge 125. This facilitates the horizontal movement of sliding panel 12 to an open position.

Foot pedal 70 can have a dimension that allows a contoured stub shaft 71 located thereon to engage a latch member 72 located along one side of frame 1. This arrangement allows sliding panel 21 to be locked in a closed position when foot pedal 70 is adjacent latch member 72.

Thus it is seen that a sliding panel such as is used in a sliding glass door assembly is provided that can create a weatherproof seal with the frame that holds the sliding panel and that can be easily slid out of the way when access to the area outside of the home is desired. One skilled in the art will appreciate that the present invention can be practiced by other than the described embodiments, which are presented for purposes of illustration and not of limitation and the present invention is limited only by the claims which follow.

I claim:

1. A sliding panel assembly having an interior side and an exterior side, said sliding panel assembly comprising:

a frame having a bottom frame member with an upper interior edge and a top frame member having an interior portion carrying a depending tongue and an exterior portion with a ledge extending toward said interior side of said sliding panel assembly;

a track disposed on said bottom frame member;

a sliding panel having a top panel member with a groove for engaging said tongue and a bottom panel member extending downwardly below the upper interior edge of said bottom frame member;

an elongated support member fixed to said bottom panel member;

a carriage member movably carried by said sliding panel generally beneath said elongated support member and containing at least one wheel, said one wheel being in engagement with said track;

a connection link pivotally connected at one of its ends to one end of said carriage member;

a bell crank having one end pivotally connected to the other end of said connection link and having its other end operatively coupled to said elongated support member;

movable operating means for operating said sliding panel assembly, said operating means carried by said sliding panel and operatively connected to said carriage member through said bell crank;

a suspension link having one end pivotally connected to said carriage member and having the other end pivotally connected to said elongated support member, whereby when said movable operating means is moved said carriage member is moved horizontally and vertically relative to said sliding panel and said sliding panel is moved vertically relative to said frame;

a first weatherstripping element in engagement between said bottom panel member and said bottom frame member; and a second weatherstripping element in engagement between said top panel member and said top frame member.

2. The sliding panel assembly of claim 1 further comprising rest means depending from said elongated support member to limit the downwardly vertical movement of said sliding panel.

3. The sliding panel assembly of claim 2 further comprising a stop means carried by said carriage assembly adjacent to said suspension link to limit the movement of said suspension link.

4. A sliding panel assembly having an interior front side and an exterior rear side, said sliding panel assembly comprising:

a frame having a bottom frame member and an upper frame member wherein said bottom frame member has a lower rear portion and an upper front portion having an interior front side with a top edge and an exterior rear side, and wherein said upper frame member has a front tongue and a downwardly extending rear portion including a ledge extending toward said interior front side;

a rod disposed along said upper front portion of said bottom frame member;

a sliding panel disposed between said top frame member and said bottom frame member and having a top panel member and a bottom panel member, said bottom panel member extending downwardly below the top edge of the interior front side of the upper front portion of the bottom frame member and including a bottom rear slot engaging a portion of a first weatherstripping element disposed adjacent to said rod and the exterior rear side of said upper front portion of said bottom frame member, said top panel member including a front groove for engaging said front tongue and an upper rear slot; and a second weatherstripping element disposed in said upper rear slot between said ledge and said upper rear slot.

5. The sliding panel assembly of claim 4, wherein said bottom panel member includes a bottom front slot between the bottom rear slot and the portion of the bottom panel member that extends below the top edge of the interior front side of the bottom frame member, said sliding panel assembly further comprising:

an elongated support member fixed to said bottom panel member in said bottom front slot;

an elongated carriage member disposed in said bottom front slot generally beneath said support member, said carriage member comprising two parallel side pieces carrying two wheels therebetween, said wheels spaced from each other along the length of said side pieces and disposed on said rod;

a connection link pivotally connected at one of its ends to one end of said carriage member;

a bell crank having one of its ends pivotally connected to the other end of said connection link and having the other end pivotally and operably connected to said elongated support member;

a suspension link having one end pivotally connected to said carriage member between said wheels and having the other end pivotally connected to said elongated support member; and a movable foot pedal connected to said sliding panel and operatively coupled to said carriage member through said bell crank, whereby moving said foot pedal moves said carriage horizontally thereby vertically raising and lowering said sliding panel relative to said frame.

6. The sliding panel assembly of claim 5 further comprising a stop means associated with said carriage member for limiting the movement of said suspension link and a rest means associated with said elongated support member to limit the vertical movement of said sliding panel.

7. The sliding panel assembly of claim 6 wherein said first and second weatherstripping elements are compressed when said sliding panel is lowered.

8. The sliding panel assembly of claim 7 wherein said frame includes a vertical member and carries a latch member having an outstanding lip and an inset notch below said lip, said foot pedal carrying a following shaft for being received by said latch member, whereby when said following shaft is pushed downwardly over said lip said sliding panel is urged toward said vertical member and when said following shaft is received in said notch said sliding panel is locked.

* * * * *